US009557662B2

(12) United States Patent
Kusano et al.

(10) Patent No.: US 9,557,662 B2
(45) Date of Patent: Jan. 31, 2017

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Keisuke Kusano, Kanagawa (JP); Jiro Korenaga, Kanagawa (JP); Yoshifumi Shoji, Kanagawa (JP); Yukimi Kawabata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/846,077

(22) Filed: Sep. 4, 2015

(65) Prior Publication Data

US 2016/0282734 A1 Sep. 29, 2016

(30) Foreign Application Priority Data

Mar. 27, 2015 (JP) ..... 2015-066295

(51) Int. Cl.
*G03G 5/05* (2006.01)
*G03G 5/06* (2006.01)

(52) U.S. Cl.
CPC ..... *G03G 5/0696* (2013.01); *G03G 5/0564* (2013.01); *G03G 5/0614* (2013.01)

(58) Field of Classification Search
CPC ..... G03G 5/051
See application file for complete search history.

(56) References Cited

U.S. PATENT DOCUMENTS 6,485,873 B1 * 11/2002 Ohkura ..... G03G 5/0605 430/56
2005/0196196 A1 9/2005 Ota et al.
2013/0288169 A1 * 10/2013 Yamano ..... G03G 5/0607 430/56

FOREIGN PATENT DOCUMENTS

JP H05-000992 A 1/1993
JP 2004-029534 A 1/2004
JP 2005-250455 A 9/2005

* cited by examiner

*Primary Examiner* — Hoa V Le
(74) *Attorney, Agent, or Firm* — Oliff PLC

(57) ABSTRACT

An electrophotographic photoreceptor includes a conductive substrate and a single-layer photosensitive layer which is provided on the conductive substrate and contains a binder resin, at least one charge generating material selected from a hydroxygallium phthalocyanine pigment and a chlorogallium phthalocyanine pigment, a first electron transporting material defined in the specification, a second electron transporting material defined in the specification, and a hole transporting material defined in the specification, wherein a total content of all electron transporting materials is greater than or equal to 4 parts by weight with respect to 100 parts by weight of a total solid content of the photosensitive layer, and an average loss elastic modulus E" of the photosensitive layer, which is obtained by measuring dynamic viscoelasticity at a temperature of from 35° C. to 50° C. and a frequency of 0.5 Hz, is less than or equal to $1.000\times10^6$.

9 Claims, 2 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-066295 filed Mar. 27, 2015.

BACKGROUND

Technical Field

The present invention relates to an electrophotographic photoreceptor, a process cartridge, and an image forming apparatus.

SUMMARY

According to an aspect of the invention, there is provided an electrophotographic photoreceptor including a conductive substrate, and a single-layer photosensitive layer which is provided on the conductive substrate and contains a binder resin, at least one charge generating material selected from a hydroxygallium phthalocyanine pigment and a chlorogallium phthalocyanine pigment, a first electron transporting material represented by the following formula (1), a second electron transporting material represented by the following formula (2), and a hole transporting material represented by the following formula (3), wherein a total content of all electron transporting materials is greater than or equal to 4 parts by weight with respect to 100 parts by weight of a total solid content of the photosensitive layer, and an average loss elastic modulus E" of the photosensitive layer, which is obtained by measuring dynamic viscoelasticity at a temperature of from 35° C. to 50° C. and a frequency of 0.5 Hz, is less than or equal to $1.000\times10^6$:

(1)

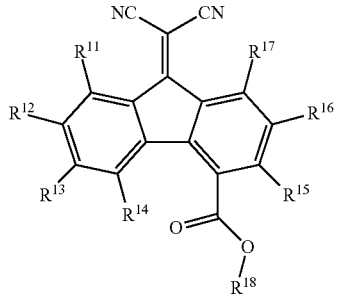

wherein $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group, $R^{18}$ represents an alkyl group, $-L^{19}-O-R^{20}$, an aryl group, or an aralkyl group, $L^{19}$ represents an alkylene group, and $R^{20}$ represents an alkyl group;

(2)

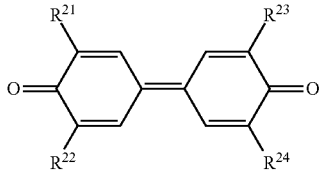

wherein $R^{21}$, $R^{22}$, $R^{23}$, and $R^{24}$ each independently represent a hydrogen atom, an alkyl group, an alkoxy group, a halogen atom, or a phenyl group; and (3)

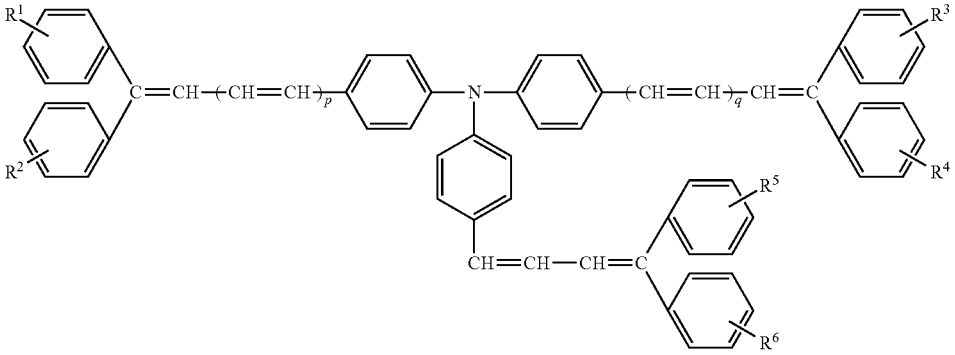

wherein $R^1$, $R^2$, $R^3$, $R^4$, $R^5$, and $R^6$ each independently represent a hydrogen atom, an alkyl group, an alkoxy group, a phenoxy group, a halogen atom, or a phenyl group which may have a substituent selected from an alkyl group, an alkoxy group, and a halogen atom, and p and q each independently represent 0 or 1.

BRIEF DESCRIPTION OF THE DRAWINGS

Exemplary embodiments of the present invention will be described in detail based on the following figures, wherein.

DETAILED DESCRIPTION

Figure 1:
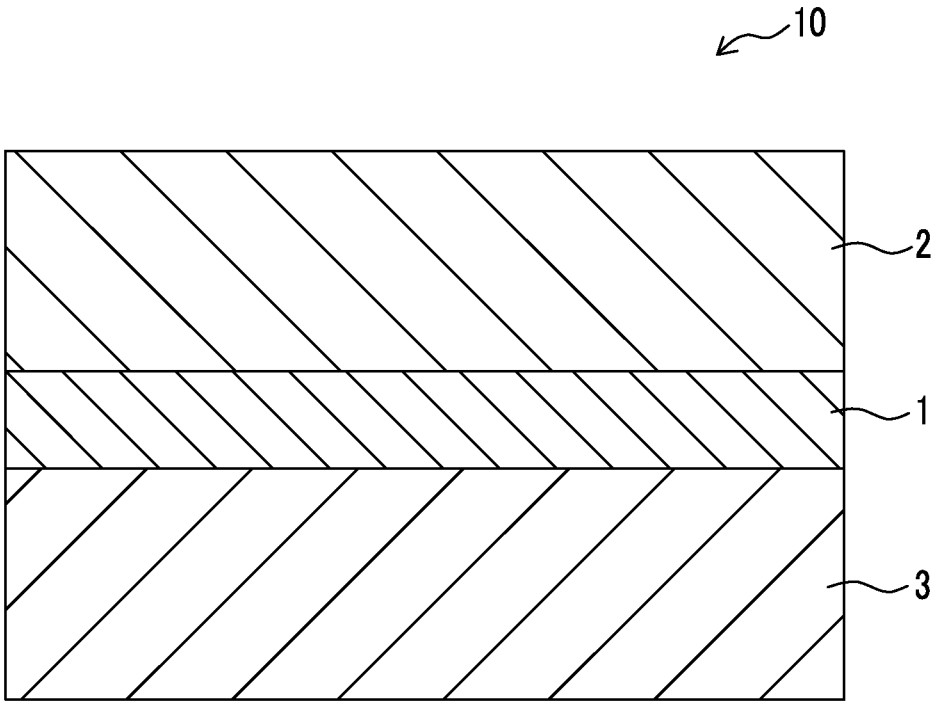
FIG. 1 is a schematic partial sectional view illustrating an electrophotographic photoreceptor according to a present exemplary embodiment.

Hereinafter, an exemplary embodiment which is an example of the invention will be described.

Electrophotographic Photoreceptor

An electrophotographic photoreceptor according to a present exemplary embodiment is a positive electrification organic photoreceptor (hereinafter, simply referred to as a "photoreceptor" or a "single-layer photoreceptor") including a conductive substrate, and a single-layer photosensitive layer on the conductive substrate.

Then, in the single-layer photosensitive layer, a binder resin, at least one charge generating material (hereinafter, referred to as a "specific charge generating material") selected from a hydroxygallium phthalocyanine pigment and a chlorogallium phthalocyanine pigment, a first electron transporting material (hereinafter, referred to as a "first electron transporting material of the formula (1)") represented by the formula (1), a second electron transporting material (hereinafter, referred to as a "second electron transporting material of the formula (2)") represented by the formula (2), and a hole transporting material (hereinafter, referred to as a "hole transporting material of the formula (3)") represented by the formula (3) are contained, the total content of total electron transporting material is greater than or equal to 4 parts by weight with respect to 100 parts by weight of the total solid content of the photosensitive layer, and an average loss elastic modulus E" at the time of measuring dynamic viscoelasticity under conditions including a temperature of 35° C. to 50° C. and a frequency of 0.5 Hz is less than or equal to $1.000\times10^6$.

Furthermore, the single-layer photosensitive layer is a photosensitive layer having hole transporting properties and electron transporting properties along with charge generating abilities.

According to the configuration described above, the photoreceptor according to the present exemplary embodiment prevents an occurrence of a color spot (for example, a dotted image occurred in the portion where no image is to be present) which occurs at the time of repeatedly forming an image in a high-temperature and high-humidity environment (for example, in an environment of 28° C. and 85%). The reason is assumed as follows.

First, the single-layer photoreceptor contains the charge generating material, the hole transporting material, and the electron transporting material in the single-layer photosensitive layer, and thus the same sensitivity as that of an organic photoreceptor including a laminated photosensitive layer is not able to be obtained, and higher sensitivity is required.

From this viewpoint, in the single-layer photosensitive layer containing the specific charge generating material, the first electron transporting material of the formula (1), and the hole transporting material of the formula (3), the sensitivity easily increases.

However, this single-layer photosensitive layer has low thermal tolerance, and thus when an image is repeatedly formed in a high-temperature and high-humidity environment (for example, in an environment of 28° C. and 85%), the color spot occurs. In particular, when the total content of the total electron transporting material with respect to 100 parts by weight of the total solid content of the photosensitive layer is greater than or equal to 4 parts by weight in order to increase the sensitivity of the single-layer photosensitive layer, the thermal tolerance of the single-layer photosensitive layer decreases, and the color spot easily occurs.

It is considered that this is because the mechanical properties of the single-layer photosensitive layer are changed according to the environmental temperature and humidity when the thermal tolerance of the single-layer photosensitive layer decreases. That is, it is considered that when the loss elastic modulus of the single-layer photosensitive layer is high within a certain temperature range, an image is repeatedly formed in a high-temperature and high-humidity environment (for example, in an environment of 28° C. and 85%), and then the color spot occurs. On the other hand, the loss elastic modulus is changed by the type and the content of the electron transporting material contained in the single-layer photosensitive layer.

Therefore, the single-layer photosensitive layer containing the specific charge generating material, the first electron transporting material of the formula (1), and the hole transporting material of the formula (3) contain the second electron transporting material of the formula (2) having high thermal tolerance. Then, the average loss elastic modulus E" of the single-layer photosensitive layer at the time of measuring the dynamic viscoelasticity under conditions including a temperature of 35° C. to 50° C. and a frequency of 0.5 Hz is less than or equal to $1.000\times10^6$. Accordingly, the thermal tolerance of the single-layer photosensitive layer increases in which the specific charge generating material, the first electron transporting material of the formula (1), and the hole transporting material of the formula (3) are contained, and the total content of the total electron transporting material is greater than or equal to 4 parts by weight with respect to 100 parts by weight of the total solid content of the photosensitive layer.

From the above description, it is assumed that the photoreceptor according to the present exemplary embodiment prevents an occurrence of a color spot which occurs at the time of repeatedly forming an image in a high-temperature and high-humidity environment (for example, in an environment of 28° C. and 85%).

In addition, in the photoreceptor according to the present exemplary embodiment, the single-layer photosensitive layer contains the specific charge generating material, the first electron transporting material of the formula (1), and the hole transporting material of the formula (3), and thus the sensitivity increases. That is, in the photoreceptor according to the present exemplary embodiment, the high sensitivity and prevention of an occurrence of a color spot in a high-temperature and high-humidity environment are concurrently realized.

Here, it is preferable that the average loss elastic modulus E" of the single-layer photosensitive layer is less than or equal to $8.0\times10^5$ from the viewpoint of prevention of an occurrence of a color spot.

The average loss elastic modulus E" of the single-layer photosensitive layer is a value measured by the following method. First, a measurement sample having a thickness of 22 μm and a size of 5 mm×30 mm is sampled from the single-layer photosensitive layer of the photoreceptor which is a measurement target. Furthermore, the measurement sample may be prepared by using a coating liquid for a single-layer photosensitive layer.

Next, dynamic elasticity of the measurement sample is measured by using a dynamic viscoelasticity measurement device DMS6100 (manufactured by Seiko Instruments Inc.), and thus the average loss elastic modulus E" is obtained. The measurement condition is a condition including a tension mode, a frequency of 0.5 Hz, and a temperature which increases from 35° C. to 50° C. at a rate of a temperature increase of 10° C./minute. Then, the average loss elastic modulus E" is obtained as the average value of 30 data items in total which are measured while the temperature increases from 35° C. to 50° C.

Hereinafter, the electrophotographic photoreceptor according to the present exemplary embodiment will be described in detail with reference to the drawings.

FIG. 1 schematically illustrates a sectional surface of a part of an electrophotographic photoreceptor 10 according to the present exemplary embodiment.

The electrophotographic photoreceptor 10 illustrated in FIG. 1, for example, includes a conductive substrate 3, and an undercoat layer 1 and a single-layer photosensitive layer 2 are disposed on the conductive substrate 3 in this order.

Furthermore, the undercoat layer 1 is a layer which is disposed as necessary. That is, the single-layer photosensitive layer 2 may be directly disposed on the conductive substrate 3, or may be disposed on the conductive substrate 3 through the undercoat layer 1.

In addition, other layers may be disposed, as necessary. Specifically, for example, a protective layer may be disposed on the single-layer photosensitive layer 2, as necessary.

Hereinafter, each layer of the electrophotographic photoreceptor according to the present exemplary embodiment will be described in detail. Furthermore, in the description, the reference numeral thereof will be omitted.

Conductive Substrate

Examples of the conductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the conductive substrate include papers, resin films, and belts which are coated, deposited, or laminated with a conductive compound (such as a conductive polymer and indium oxide), a metal (such as aluminum, palladium, and gold), or alloys thereof. The term "conductive" means that the volume resistivity is less than $10^{13}$ Ωcm.

When the electrophotographic photoreceptor is used in a laser printer, the surface of the conductive substrate is preferably roughened so as to have a centerline average roughness (Ra) of 0.04 μm to 0.5 μm sequentially to prevent interference fringes which are formed when irradiated by laser light. Further, when an incoherent light is used as a light source, surface roughening for preventing interference fringes is not particularly necessary, but occurrence of defects due to the irregularities on the surface of the conductive substrate is prevented, which is thus suitable for achieving a longer service life.

Examples of a surface roughening method include wet honing which is performed by suspending an abrading agent in water and by spraying the suspension to a support, centerless grinding which is performed by pressing the conductive substrate to be in contact with a rotating grinding stone and by continuously performing grinding processing, anodization, and the like.

Other examples of the method for surface roughening include a method for surface roughening by forming a layer of a resin in which conductive or semiconductive particles are dispersed on the surface of a conductive substrate so that the surface roughening is achieved by the particles dispersed in the layer, without roughing the surface of the conductive substrate.

In the surface roughening treatment by anodic oxidation, an oxide film is formed on the surface of a conductive substrate by anodic oxidation in which a metal (for example, aluminum) conductive substrate as an anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The film thickness of the anodic oxide film is preferably from 0.3 μm to 15 μm. When the thickness of the anodic oxide film is within the above range, a barrier property against injection tends to be exerted and an increase in the residual potential due to the repeated use tends to be prevented.

The conductive substrate may be subjected to a treatment with an acidic aqueous solution or a boehmite treatment.

The treatment with an acidic treatment solution is carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing it into contact with heated water vapor at a temperature of 90° C. to 120° C. for 5 minutes to 60 minutes. The film thickness is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

The undercoat layer is, for example, a layer including inorganic particles and a binder resin.

Examples of the inorganic particles include inorganic particles having powder resistance (volume resistivity) of about $10^2$ Ωcm to $10^{11}$ Ωcm.

Among these, as the inorganic particles having the resistance values above, metal oxide particles such as tin oxide particles, titanium oxide particles, zinc oxide particles, and zirconium oxide particles are preferable, and zinc oxide particles are more preferable.

The specific surface area of the inorganic particles as measured by a BET method is, for example, preferably 10 $m^2/g$ or more.

The volume average particle diameter of the inorganic particles is, for example, preferably from 50 nm to 2,000 nm (preferably from 60 nm to 1,000 nm).

The content of the inorganic particles is, for example, preferably from 10% by weight to 80% by weight, and more preferably from 40% by weight to 80% by weight, based on the binder resin.

The inorganic particles may be the ones which have been subjected to a surface treatment. The inorganic particles which have been subjected to different surface treatments or have different particle diameters may be used in combination of two or more kinds.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

These silane coupling agents may be used as a mixture of two or more kinds thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method using a surface treatment agent may be any one of known methods, and may be either a dry method or a wet method.

The amount of the surface treatment agent for treatment is, for example, preferably from 0.5% by weight to 10% by weight, based on the inorganic particles.

Here, inorganic particles and an electron acceptive compound (acceptor compound) are preferably included in the undercoat layer from the viewpoint of superior long-term stability of electrical characteristics and carrier blocking property.

Examples of the electron acceptive compound include electron transporting materials such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Particularly, as the electron acceptive compound, compounds having an anthraquinone structure are preferable. As the electron acceptive compounds having an anthraquinone structure, hydroxyanthraquinone compounds, aminoanthraquinone compounds, aminohydroxyanthraquinone compounds, and the like are preferable, and specifically, anthraquinone, alizarin, quinizarin, anthrarufin, purpurin, and the like are preferable.

The electron acceptive compound may be included as dispersed with the inorganic particles in the undercoat layer, or may be included as attached to the surface of the inorganic particles.

Examples of the method of attaching the electron acceptive compound to the surface of the inorganic particles include a dry method and a wet method.

The dry method is a method for attaching an electron acceptive compound to the surface of the inorganic particles, in which the electron acceptive compound is added dropwise to the inorganic particles or sprayed thereto together with dry air or nitrogen gas, either directly or in the form of a solution in which the electron acceptive compound is dissolved in an organic solvent, while the inorganic particles are stirred with a mixer or the like having a high shearing force. The addition or spraying of the electron acceptive compound is preferably carried out at a temperature no higher than the boiling point of the solvent. After the addition or spraying of the electron acceptive compound, the inorganic particles may further be subjected to baking at a temperature of 100° C. or higher. The baking may be carried out at any temperature and timing without limitation, by which desired electrophotographic characteristics may be obtained.

The wet method is a method for attaching an electron acceptive compound to the surface of the inorganic particles, in which the inorganic particles are dispersed in a solvent by means of stirring, ultrasonic wave, a sand mill, an attritor, a ball mill, or the like, then the electron acceptive compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and timing without limitation, in which desired electrophotographic characteristics may be obtained. In the wet method, the moisture contained in the inorganic particles may be removed prior to adding the surface treatment agent, and examples of a method for removing the moisture include a method for removing the moisture by stirring and heating the inorganic particles in a solvent or by azeotropic removal with the solvent.

Furthermore, the attachment of the electron acceptive compound may be carried out before or after the inorganic particles are subjected to a surface treatment using a surface treatment agent, and the attachment of the electron acceptive compound may be carried out at the same time with the surface treatment using a surface treatment agent.

The content of the electron acceptive compound is, for example, preferably from 0.01% by weight to 20% by weight, and more preferably from 0.01% by weight to 10% by weight, based on the inorganic particles.

Examples of the binder resin used in the undercoat layer include known materials, such as well-known polymeric compounds such as acetal resins (for example, polyvinylbutyral), polyvinyl alcohol resins, polyvinyl acetal resins, casein resins, polyamide resins, cellulose resins, gelatins, polyurethane resins, polyester resins, unsaturated polyether resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins having charge transporting groups, and conductive resins (for example, polyaniline).

Among these, as the binder resin used in the undercoat layer, a resin which is insoluble in a coating solvent of an upper layer is suitable, and particularly, resins obtained by reacting thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from the group consisting of polyamide resins, polyester resins, polyether resins, methacrylic resins, acrylic resins, polyvinyl alcohol resins, and polyvinyl acetal resins with curing agents are suitable.

In the case where these binder resins are used in combination of two or more kinds thereof, the mixing ratio is set as appropriate.

Various additives may be used for the undercoat layer to improve electrical characteristics, environmental stability, or image quality.

Examples of the additives include known materials such as the polycyclic condensed type or azo type of the electron transporting pigments, zirconium chelate compounds, titanium chelate compounds, aluminum chelate compounds, titanium alkoxide compounds, organic titanium compounds, and silane coupling agents. A silane coupling agent, which is used for surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl)titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used singly, or as a mixture or a polycondensate of two or more kinds thereof.

The Vickers hardness of the undercoat layer is preferably 35 or more.

The surface roughness of the undercoat layer (ten point height of irregularities) is adjusted in the range of from $(1/(4n))\lambda$ to $(1/2)\lambda$, in which $\lambda$ represents the wavelength of the laser for exposure and n represents a refractive index of the upper layer, in order to prevent a moire image.

Resin particles and the like may be added in the undercoat layer in order to adjust the surface roughness. Examples of the resin particles include silicone resin particles and cross-linked polymethyl methacrylate resin particles. In addition, the surface of the undercoat layer may be polished in order to adjust the surface roughness. Examples of the polishing method include buffing polishing, a sandblasting treatment, wet honing, and a grinding treatment.

The formation of the undercoat layer is not particularly limited, and well-known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for forming the coating liquid for forming the undercoat layer include alcohol solvents, aromatic hydrocarbon solvents, hydrocarbon halide solvents, ketone solvents, ketone alcohol solvents, ether solvents, and ester solvents.

Examples of these solvents include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, a paint shaker, and the like.

Further, as a method for coating the coating liquid for forming an undercoat layer onto a conductive substrate include ordinary methods such as a blade coating method, a wire bar coating method, a spraying method, a dipping coating method, a bead coating method, an air knife coating method, and a curtain coating method.

The film thickness of the undercoat layer is set to a range of, for example, preferably 15 μm or more, and more preferably from 20 μm to 50 μm.

Intermediate Layer

Although not shown in the figures, an intermediate layer may be provided between the undercoat layer and the photosensitive layer.

The intermediate layer is, for example, a layer including a resin. Examples of the resin used in the intermediate layer include polymeric compounds such as acetal resins (for example polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organic metal compound. Examples of the organic metal compound used in the intermediate layer include organic metal compounds containing a metal atom such as zirconium, titanium, aluminum, manganese, and silicon.

These compounds used in the intermediate layer may be used singly or as a mixture or a polycondensate of plural compounds.

Among these, layers containing organometallic compounds containing a zirconium atom or a silicon atom are preferable.

The formation of the intermediate layer is not particularly limited, and well-known forming methods are used. However, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, ordinary methods such as a dipping coating method, an extrusion coating method, a wire bar coating method, a spraying method, a blade coating method, a knife coating method, and a curtain coating method are used.

The film thickness of the intermediate layer is set to, for example, preferably from 0.1 μm to 3 Further, the intermediate layer may be used as an undercoat layer.

Single-layer Photosensitive Layer

The single-layer photosensitive layer contains the binder resin, the charge generating material, the electron transporting material, and the hole transporting material. The single-layer photosensitive layer may contain other additives, as necessary.

Binding Resin

Examples of the binder resin are not particularly limited, and for example, include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinyl carbazole, polysilane, and the like. These binder resins may be independently used or a combination of two or more thereof may be used.

Among these binder resins, for example, a polycarbonate resin of which the viscosity average molecular weight is from 30,000 to 80,000 is particularly preferable from a viewpoint of the film forming properties of the photosensitive layer.

The content of the binder resin with respect to the total solid content of the photosensitive layer may be from 35% by weight to 60% by weight, and is preferably from 20% by weight to 35% by weight.

Charge Generating Material

As the charge generating material, at least one selected from the hydroxygallium phthalocyanine pigment and the chlorogallium phthalocyanine pigment is applied.

As the charge generating material, these pigments may be independently used, or may be used in combination, as necessary. Then, as the charge generating material, the hydroxygallium phthalocyanine pigment is preferable from a viewpoint of the high sensitivity of the photoreceptor and prevention of an occurrence of a color spot in an image.

The hydroxygallium phthalocyanine pigment is not particularly limited, and as the hydroxygallium phthalocyanine pigment, a V-type hydroxygallium phthalocyanine pigment is more preferable from a viewpoint of the high sensitivity of the photoreceptor and prevention of an occurrence of a color spot in an image.

In particular, as the hydroxygallium phthalocyanine pigment, for example, the hydroxygallium phthalocyanine pigment having the maximum peak wavelength within a range of 810 nm to 839 nm at a spectral absorption spectrum in a wavelength region of 600 nm to 900 nm is preferable from a viewpoint of more excellent dispersibility. When the hydroxygallium phthalocyanine pigment is used as the material of the electrophotographic photoreceptor, excellent dispersibility and sufficient sensitivity, charging properties, and dark attenuation properties are able to be easily obtained.

In addition, in the hydroxygallium phthalocyanine pigment having the maximum peak wavelength within the range of 810 nm to 839 nm, it is preferable that the average particle diameter is in a specific range, and a BET specific surface area is in a specific range. Specifically, the average particle diameter is preferably less than or equal to 0.20 μm, and is more preferably from 0.01 μm to 0.15 μm. On the other hand, the BET specific surface area is preferably greater than or equal to 45 $m^2/g$, is more preferably greater than or equal to 50 $m^2/g$, and is particularly preferably from 55 $m^2/g$ to 120 $m^2/g$. The average particle diameter is a value which is measured by a volume average particle diameter (a d50 average particle diameter) using a laser diffraction and scattering type particle diameter distribution measurement device (LA-700, manufactured by Horiba Ltd.). In addition, the average particle diameter is a value which is measured by a nitrogen substitution method using BET type specific surface area measurement device (manufactured by Shimadzu Corporation: Flow Soap II2300).

Here, when the average particle diameter is greater than 0.20 μm or when the specific surface area value is less than 45 $m^2/g$, pigment particles may be coarsened or the aggregate of the pigment particles may be formed. Then, a defect may easily occur in properties such as dispersibility, sensitivity, charging properties, and dark attenuation properties, and thus an image quality defect easily occurs.

The maximum particle diameter of the hydroxygallium phthalocyanine pigment (the maximum value of a primary particle diameter) is preferably less than or equal to 1.2 μm, is more preferably less than or equal to 1.0 μm, is even more preferably less than or equal to 0.3 μm. When this maximum particle diameter exceeds the range described above, a black point easily occurs.

In the hydroxygallium phthalocyanine pigment, it is preferable that the average particle diameter is less than or equal to 0.2 μm, the maximum particle diameter is less than or equal to 1.2 μm, and the specific surface area value is greater than or equal to 45 $m^2/g$ from a viewpoint of preventing density unevenness which is caused by exposing the photoreceptor to a fluorescent lamp or the like.

It is preferable that the hydroxygallium phthalocyanine pigment is a V-type hydroxygallium phthalocyanine pigment having a diffraction peak at a Bragg angle ($2\theta \pm 0.2°$) of at least 7.3°, 16.0°, 24.9°, and 28.0° in an X-ray diffraction spectrum using a CuKα characteristic X-ray.

On the other hand, the chlorogallium phthalocyanine pigment is not particularly limited, and as the chlorogallium phthalocyanine pigment, a chlorogallium phthalocyanine pigment having a diffraction peak at a Bragg angle ($2\theta \pm 0.2°$) of 7.4°, 16.6°, 25.5°, and 28.3° at which excellent sensitivity is able to be obtained as the material of the electrophotographic photoreceptor is preferable.

In the chlorogallium phthalocyanine pigment, the maximum peak wavelength of the preferable spectral absorption spectrum, the average particle diameter, the maximum particle diameter, and the specific surface area value are identical to those of the hydroxygallium phthalocyanine pigment.

The content of the charge generating material with respect to the total solid content of the photosensitive layer may be from 1% by weight to 5% by weight, and is preferably from 1.2% by weight to 4.5% by weight.

Electron Transporting Material

As the electron transporting material, the first electron transporting material of the formula (1) (the first electron transporting material represented by the formula (1)) and the second electron transporting material of the formula (2) (the second electron transporting material represented by the formula (2)) are applied.

First, the first electron transporting material of the formula (1) (the first electron transporting material represented by the formula (1)) will be described.

(1)

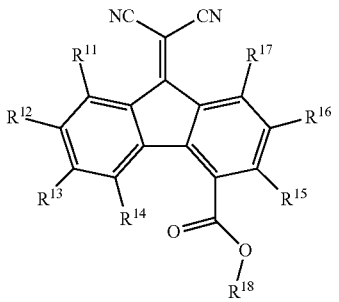

In the formula (1), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group. $R^{18}$ represents an alkyl group, $-L^{19}-O-R^{20}$, an aryl group, or an aralkyl group. In addition, $L^{19}$ represents an alkylene group, and $R^{20}$ represents an alkyl group.

In the formula (1), examples of the halogen atom represented by $R^{11}$ to $R^{17}$ include a fluorine atom, a chlorine atom, a bromine atom, an iodine atom, and the like.

In the formula (1), examples of the alkyl group represented by $R^{11}$ to $R^{17}$ include a straight-chain or branched alkyl group having 1 to 4 (preferably 1 to 3) carbon atoms, and specifically, for example, include a methyl group, an ethyl group, a n-propyl group, an isopropyl group, a n-butyl group, an isobutyl group, and the like.

In the formula (1), examples of the alkoxy group represented by $R^{11}$ to $R^{17}$ include an alkoxy group having 1 to 4 (preferably 1 to 3) carbon atoms, and specifically, include a methoxy group, an ethoxy group, a propoxy group, a butoxy group, and the like.

In the formula (1), examples of the aryl group represented by $R^{11}$ to $R^{17}$ include a phenyl group, a tolyl group, and the like. Among them, as the aryl group represented by $R^{11}$ to $R^{17}$, the phenyl group is preferable.

In the formula (1), examples of the aralkyl group represented by $R^{11}$ to $R^{17}$ include a benzyl group, a phenethyl group, a phenyl propyl group, and the like.

In the formula (1), examples of the alkyl group represented by $R^{18}$ include a straight-chain alkyl group having 1 to 12 carbon atoms (preferably 5 to 10 carbon atoms), and a branched alkyl group having 3 to 10 carbon atoms (preferably 5 to 10 carbon atoms).

Examples of the straight-chain alkyl group having 1 to 12 carbon atoms include a methyl group, an ethyl group, a n-propyl group, a n-butyl group, a n-pentyl group, a n-hexyl group, a n-heptyl group, a n-octyl group, a n-nonyl group, a n-decyl, a n-undecyl, a n-dodecyl group, and the like.

Examples of the branched alkyl group having 3 to 10 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, and the like.

In the formula (1), in $-L^{19}-O-R^{20}$ group represented by $R^{18}$, $L^{19}$ represents an alkylene group, and $R^{20}$ represents an alkyl group.

Examples of the alkylene group represented by $L^{19}$ include a straight-chain or branched alkylene group having 1 to 12 carbon atoms, and include a methylene group, an ethylene group, a n-propylene group, an isopropylene group, a n-butylene group, an isobutylene group, a sec-butylene group, a tert-butylene group, a n-pentylene group, an isopentylene group, a neopentylene group, a tert-pentylene group, and the like.

Examples of the alkyl group represented by $R^{20}$ include the same groups as those of the alkyl group represented by $R^{11}$ to $R^{17}$ described above.

In the formula (1), examples of the aryl group represented by $R^{18}$ include a phenyl group, a methyl phenyl group, a dimethyl phenyl group, an ethyl phenyl group, and the like.

Furthermore, as the aryl group represented by $R^{18}$, an alkyl substituted aryl group which is substituted with an alkyl group is preferable from a viewpoint of solubility. Examples of the alkyl group of the alkyl substituted aryl group include the same groups as those of the alkyl group represented by $R^{11}$ to $R^{17}$.

In the formula (1), examples of the aralkyl group represented by $R^{18}$, include groups represented by $-R^{18A}-Ar$. In this case, $R^{18A}$ represents an alkylene group, and Ar represents an aryl group.

Examples of the alkylene group represented by $R^{18A}$, include a straight-chain or branched alkylene group having 1 to 12 carbon atoms, and include a methylene group, an ethylene group, a n-propylene group, an isopropylene group, a n-butylene group, an isobutylene group, a sec-butylene group, a tert-butylene group, a n-pentylene group, an isopentylene group, a neopentylene group, a tert-pentylene group, and the like.

Examples of the aryl group represented by Ar, include a phenyl group, a methyl phenyl group, a dimethyl phenyl group, an ethyl phenyl group, and the like.

In the formula (1), examples of the aralkyl group represented by $R^{18}$, specifically include a benzyl group, a methyl benzyl group, a dimethyl benzyl group, a phenyl ethyl group, a methyl phenyl ethyl group, a phenyl propyl group, a phenyl butyl group, and the like.

As the first electron transporting material of the formula (1), an electron transporting material is preferable in which $R^{18}$ represents a branched alkyl group or aralkyl group having 5 to 10 carbon atoms, and an electron transporting material in which $R^{11}$ to $R^{17}$ each independently represent a hydrogen atom, a halogen atom, or an alkyl group, and $R^{18}$ represents a branched alkyl group or aralkyl group having 5 to 10 carbon atoms is particularly preferable, from a viewpoint of high sensitivity and prevention of an occurrence of a color spot.

Hereinafter, an exemplary compound of the first electron transporting material of the formula (1) will be described, but is not limited thereto. Furthermore, the following exemplary compound number will be described as Exemplary Compound (1-Number). Specifically, for example, Exemplary Compound 15 will be described as "Exemplary Compound (1-15)".

In the formula (2), examples of the halogen atom represented by $R^{21}$ to $R^{24}$ include a chlorine atom, an iodine atom, a bromine atom, a fluorine atom, and the like.

In the formula (2), the phenyl group represented by $R^{21}$ to $R^{24}$ may be a substituted phenyl group. Examples of the substituent of the substituted phenyl group include an alkyl group (for example, an alkyl group having 1 to 6 carbon atoms), an alkoxy group (for example, an alkoxy group having 1 to 6 carbon atoms), a biphenyl group, and the like.

| Exemplary Compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| 1 | H | H | H | H | H | H | H | —n-$C_7H_{16}$ |
| 2 | H | H | H | H | H | H | H | —n-$C_8H_{17}$ |
| 3 | H | H | H | H | H | H | H | —n-$C_5H_{11}$ |
| 4 | H | H | H | H | H | H | H | —n-$C_{10}H_{21}$ |
| 5 | Cl | Cl | Cl | Cl | Cl | Cl | Cl | —n-$C_2H_{15}$ |
| 6 | H | Cl | H | Cl | H | Cl | Cl | —n-$C_2H_{15}$ |
| 7 | $CH_3$ | $CH_3$ | $CH_3$ | $CH_3$ | $CH_3$ | $CH_3$ | $CH_3$ | —n-$C_7H_{15}$ |
| 8 | $C_4H_9$ | $C_4H_9$ | $C_4H_9$ | $C_4H_9$ | $C_4H_9$ | $C_4H_9$ | $C_4H_9$ | —n-$C_7H_{15}$ |
| 9 | $CH_3O$ | H | $CH_3O$ | H | $CH_3O$ | H | $CH_3O$ | —n-$C_8H_{17}$ |
| 10 | $C_6H_5$ | $C_6H_5$ | $C_6H_5$ | $C_6H_5$ | $C_6H_5$ | $C_6H_5$ | $C_6H_5$ | —n-$C_8H_{17}$ |
| 11 | H | H | H | H | H | H | H | —n-$C_4H_9$ |
| 12 | H | H | H | H | H | H | H | —n-$C_{11}H_{23}$ |
| 13 | H | H | H | H | H | H | H | —n-$C_9H_{19}$ |
| 14 | H | H | H | H | H | H | H | —$CH_2$—$CH(CH_2H_6)$—$C_4H_9$ |
| 15 | H | H | H | H | H | H | H | —$(CH_2)_2$—Ph |
| 16 | H | H | H | H | H | H | H | —$CH_2$—Ph |
| 17 | H | H | H | H | H | H | H | —n-$C_{12}H_{26}$ |
| 18 | H | H | H | H | H | H | H | —$C_2H_5$—O—$CH_3$ |

Furthermore, an ellipsis notation of the exemplary compound described above indicates the following meaning.

Ph: Phenyl Group

Next, the electron transporting material of the formula (2) (the second electron transporting material represented by the formula (2)) will be described.

(2)

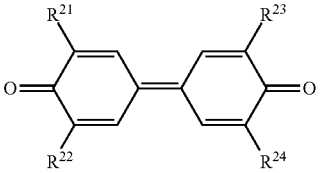

In the formula (2), $R^{21}$, $R^{22}$, $R^{23}$, and $R^{24}$ each independently represent a hydrogen atom, an alkyl group, an alkoxy group, a halogen atom, or a phenyl group.

In the formula (2), examples of the alkyl group represented by $R^{21}$ to $R^{24}$ include a straight-chain or branched alkyl group having 1 to 6 carbon atoms, and specifically include a methyl group, an ethyl group, a n-propyl group, an isopropyl group, a n-butyl group, an isobutyl group, a tert-butyl group, a pentyl group, a hexyl group, and the like.

The alkyl group represented by $R^{21}$ to $R^{24}$ may be a substituted alkyl group. Examples of the substituent of the substituted alkyl group include a cycloalkyl group, a fluorine substituted alkyl group, and the like.

In the formula (2), examples of the alkoxy group represented by $R^{21}$ to $R^{24}$ include an alkoxy group having atoms 1 to 6 carbon atoms, and specifically, include a methoxy group, an ethoxy group, a propoxy group, a butoxy group, and the like.

As the second electron transporting material of the formula (2), an electron transporting material is preferable in which at least one of $R^{21}$ to $R^{24}$ (preferably, greater than or equal to 3) represents a branched alkyl group having 4 carbon atoms, from a viewpoint of high sensitivity and prevention of an occurrence of a color spot.

Hereinafter, an exemplary compound of the second electron transporting material of the formula (2) will be described, but is not limited thereto. Furthermore, a number attached to the exemplary compounds will be described as Exemplary Compound (2-Number).

Specifically, for example, the number (2) attached to the exemplary compound will be described as "Exemplary Compound (2-2)".

(1)

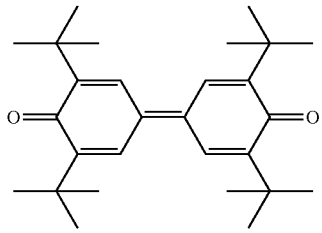

(2)

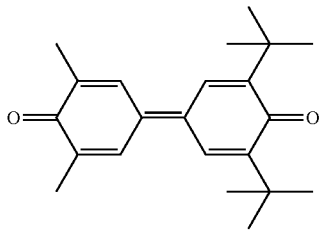

-continued (3)

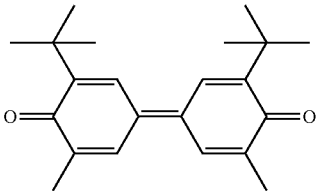

Here, each of the first electron transporting material of the formula (1) and the second electron transporting material of the formula (2) may be independently used, or a combination of two or more thereof may be used. In addition, within a range not impairing the object of the present exemplary embodiment, other electron transporting materials other than the first electron transporting material of the formula (1) and the second electron transporting material of the formula (2) may be used together, as necessary.

Furthermore, it is preferable that the content at the time of containing the other electron transporting material is less than or equal to 10% by weight with respect to the total electron transporting material.

Examples of the other electron transporting material include an electron transporting compound such as a quinone compound such as p-benzoquinone, chloranil, bromanil, and anthraquinone, a tetracyanoquinodimethane compound, a fluorenone compound such as 2,4,7-trinitrofluorenone, a xanthone compound, a benzophenone compound, a cyanovinyl compound, an ethylene compound, and the like.

One of these electron transporting materials may be independently used or a combination of two or more thereof may be used, but the electron transporting material is not limited thereto.

Next, the content of the electron transporting material will be described.

The total content of the total electron transporting material is greater than or equal to 4 parts by weight, and is preferably greater than or equal to 5 parts by weight, from a viewpoint of high sensitivity, with respect to 100 parts by weight of the total solid content of the photosensitive layer.

In addition, a ratio of the first electron transporting material of the formula (1) and the second electron transporting material of the formula (2) is preferably from 2/1 to 4/1 by a weight ratio (the first electron transporting material of the formula (1)/the second electron transporting material of the formula (2)), from a viewpoint of high sensitivity and prevention of an occurrence of a color spot.

Hole Transporting Material

As the hole transporting material, the hole transporting material of the formula (3) (the hole transporting material represented by the formula (3)) is applied.

In the formula (3), $R^1$, $R^2$, $R^3$, $R^4$, $R^5$, and $R^6$ each independently represent a hydrogen atom, an alkyl group, an alkoxy group, a phenoxy group, a halogen atom, or a phenyl group which may have a substituent selected from an alkyl group, an alkoxy group, and a halogen atom. p and q each independently represent 0 or 1.

In the formula (3), examples of the alkyl group represented by $R^1$ to $R^6$ include a straight-chain or branched alkyl group having 1 to 4 carbon atoms, and specifically include a methyl group, an ethyl group, a n-propyl group, an isopropyl group, a n-butyl group, an isobutyl group, and the like.

Among them, as the alkyl group, the methyl group, and the ethyl group are preferable.

In the formula (3), examples of the alkoxy group represented by $R^1$ to $R^6$ include an alkoxy group having 1 to 4 carbon atoms, and specifically, include a methoxy group, an ethoxy group, a propoxy group, a butoxy group, and the like.

In the formula (3), examples of the halogen atom represented by $R^1$ to $R^6$ include a fluorine atom, a chlorine atom, a bromine atom, an iodine atom, and the like.

In the formula (3), examples of the phenyl group represented by $R^1$ to $R^6$ include an unsubstituted phenyl group; a lower alkyl group substituted phenyl group such as a p-tolyl group, and a 2,4-dimethyl phenyl group; a lower alkoxy group substituted phenyl group such as a p-methoxy phenyl group; a halogen atom substituted phenyl group such as a p-chlorophenyl group, and the like.

Furthermore, examples of the substituent with which the phenyl group is able to be substituted include the alkyl group, the alkoxy group, and the halogen atom which are represented by $R^1$ to $R^6$.

In the hole transporting materials of the formula (3), a hole transporting material is preferable in which p and q represent 1, and a hole transporting material is more preferable in which $R^1$ to $R^6$ each independently represent a hydrogen atom, an alkyl group, or an alkoxy group, and p and q represent 1, from a viewpoint of high sensitivity and prevention of an occurrence of a color spot.

Hereinafter, exemplary compounds of the hole transporting material of the formula (3) will be described, but are not limited thereto.

Furthermore, the following exemplary compound numbers will be described as Exemplary Compound (3-Number). Specifically, for example, Exemplary Compound 15 will be described as "Exemplary Compound (3-15)".

(3)

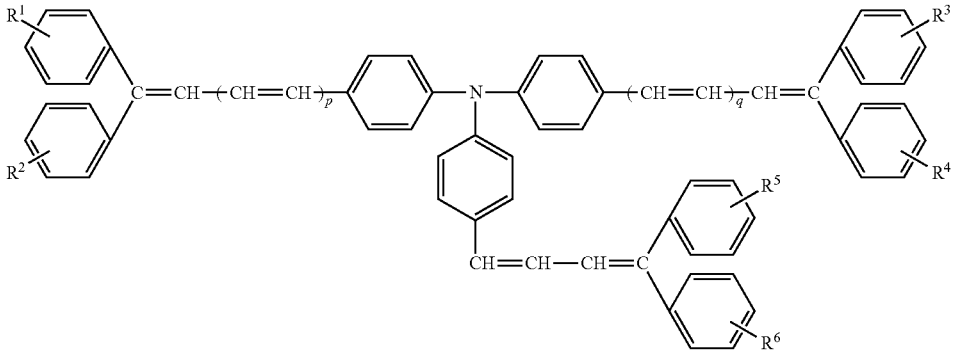

| Exemplary Compound | p | q | $R^1$ | $R^2$ | $R^3$ | $R^4$ | $R^5$ | $R^6$ |
|---|---|---|---|---|---|---|---|---|
| 1 | 1 | 1 | H | H | H | H | H | H |
| 2 | 1 | 1 | 4-Me | 4-Me | 4-Me | 4-Me | 4-Me | 4-Me |
| 3 | 1 | 1 | 4-Me | 4-Me | H | H | 4-Me | 4-Me |
| 4 | 1 | 1 | 4-Me | H | 4-Me | H | 4-Me | H |
| 5 | 1 | 1 | H | H | 4-Me | 4-Me | H | H |
| 6 | 1 | 1 | 3-Me | 3-Me | 3-Me | 3-Me | 3-Me | 3-Me |
| 7 | 1 | 1 | H | H | H | H | 4-Cl | 4-Cl |
| 8 | 1 | 1 | 4-MeO | H | 4-MeO | H | 4-MeO | H |
| 9 | 1 | 1 | H | H | H | H | 4-MeO | 4-MeO |
| 10 | 1 | 1 | 4-MeO | 4-MeO | 4-MeO | 4-MeO | 4-MeO | 4-MeO |
| 11 | 1 | 1 | 4-MeO | H | 4-MeO | H | 4-MeO | 4-MeO |
| 12 | 1 | 1 | 4-Me | H | 4-Me | H | 4-Me | 4-F |
| 13 | 1 | 1 | 3-Me | H | 3-Me | H | 3-Me | H |
| 14 | 1 | 1 | 4-Cl | H | 4-Cl | H | 4-Cl | H |
| 15 | 1 | 1 | 4-Cl | 4-Cl | 4-Cl | 4-Cl | 4-Cl | 4-Cl |
| 16 | 1 | 1 | 3-Me | 3-Me | 3-Me | 3-Me | 3-Me | 3-Me |
| 17 | 1 | 1 | 4-Me | 4-MeO | 4-Me | 4-MeO | 4-Me | 4-MeO |
| 18 | 1 | 1 | 3-Me | 4-MeO | 3-Me | 4-MeO | 3-Me | 4-MeO |
| 19 | 1 | 1 | 3-Me | 4-Cl | 3-Me | 4-Cl | 3-Me | 4-Cl |
| 20 | 1 | 1 | 4-Me | 4-Cl | 4-Me | 4-Cl | 4-Me | 4-Cl |
| 21 | 1 | 0 | H | H | H | H | H | H |
| 22 | 1 | 0 | 4-Me | 4-Me | 4-Me | 4-Me | 4-Me | 4-Me |
| 23 | 1 | 0 | 4-Me | 4-Me | H | H | 4-Me | 4-Me |
| 24 | 1 | 0 | H | H | 4-Me | 4-Me | H | H |
| 25 | 1 | 0 | H | H | 3-Me | 3-Me | H | H |
| 26 | 1 | 0 | H | H | 4-Cl | 4-Cl | H | H |
| 27 | 1 | 0 | 4-Me | H | H | H | 4-Me | H |
| 28 | 1 | 0 | 4-MeO | H | H | H | 4-MeO | H |
| 29 | 1 | 0 | H | H | 4-MeO | 4-MeO | H | H |
| 30 | 1 | 0 | 4-MeO | 4-MeO | 4-MeO | 4-MeO | 4-MeO | 4-MeO |
| 31 | 1 | 0 | 4-MeO | H | 4-MeO | H | 4-MeO | 4-MeO |
| 32 | 1 | 0 | 4-Me | H | 4-Me | H | 4-Me | 4-F |
| 33 | 1 | 0 | 3-Me | H | 3-Me | H | 3-Me | H |
| 34 | 1 | 0 | 4-Cl | H | 4-Cl | H | 4-Cl | H |
| 35 | 1 | 0 | 4-Cl | 4-Cl | 4-Cl | 4-Cl | 4-Cl | 4-Cl |
| 36 | 1 | 0 | 3-Me | 3-Me | 3-Me | 3-Me | 3-Me | 3-Me |
| 37 | 1 | 0 | 4-Me | 4-MeO | 4-Me | 4-MeO | 4-Me | 4-MeO |
| 38 | 1 | 0 | 3-Me | 4-MeO | 3-Me | 4-MeO | 3-Me | 4-MeO |
| 39 | 1 | 0 | 3-Me | 4-Cl | 3-Me | 4-Cl | 3-Me | 4-Cl |
| 40 | 1 | 0 | 4-Me | 4-Cl | 4-Me | 4-Cl | 4-Me | 4-Cl |
| 41 | 0 | 0 | H | H | H | H | H | H |
| 42 | 0 | 0 | 4-Me | 4-Me | 4-Me | 4-Me | 4-Me | 4-Me |
| 43 | 0 | 0 | 4-Me | 4-Me | 4-Me | 4-Me | H | H |
| 44 | 0 | 0 | 4-Me | H | 4-Me | H | H | H |
| 45 | 0 | 0 | H | H | H | H | 4-Me | 4-Me |
| 46 | 0 | 0 | 3-Me | 3-Me | 3-Me | 3-Me | H | H |
| 47 | 0 | 0 | H | H | H | H | 4-Cl | 4-Cl |
| 48 | 0 | 0 | 4-MeO | H | 4-MeO | H | H | H |
| 49 | 0 | 0 | H | H | H | H | 4-MeO | 4-MeO |
| 50 | 0 | 0 | 4-MeO | 4-MeO | 4-MeO | 4-MeO | 4-MeO | 4-MeO |
| 51 | 0 | 0 | 4-MeO | H | 4-MeO | H | 4-MeO | 4-MeO |
| 52 | 0 | 0 | 4-Me | H | 4-Me | H | 4-Me | 4-F |
| 53 | 0 | 0 | 3-Me | H | 3-Me | H | 3-Me | H |
| 54 | 0 | 0 | 4-Cl | H | 4-Cl | H | 4-Cl | H |
| 55 | 0 | 0 | 4-Cl | 4-Cl | 4-Cl | 4-Cl | 4-Cl | 4-Cl |
| 56 | 0 | 0 | 3-Me | 3-Me | 3-Me | 3-Me | 3-Me | 3-Me |
| 57 | 0 | 0 | 4-Me | 4-MeO | 4-Me | 4-MeO | 4-Me | 4-MeO |
| 58 | 0 | 0 | 3-Me | 4-MeO | 3-Me | 4-MeO | 3-Me | 4-MeO |
| 59 | 0 | 0 | 3-Me | 4-Cl | 3-Me | 4-Cl | 3-Me | 4-Cl |
| 60 | 0 | 0 | 4-Me | 4-Cl | 4-Me | 4-Cl | 4-Me | 4-Cl |
| 61 | 1 | 1 | 4-Pr | 4-Pr | 4-Pr | 4-Pr | 4-Pr | 4-Pr |
| 62 | 1 | 1 | 4-PhO | 4-PhO | 4-PhO | 4-PhO | 4-PhO | 4-PhO |
| 63 | 1 | 1 | H | 4-Me | H | 4-Me | H | 4-Me |
| 64 | 1 | 1 | $4\text{-}C_6H_5$ | $4\text{-}C_6H_5$ | $4\text{-}C_6H_5$ | $4\text{-}C_6H_5$ | $4\text{-}C_6H_5$ | $4\text{-}C_6H_5$ |

Furthermore, an ellipsis notation of the exemplary compound described above indicates the following meaning.

4-Me: a methyl group substituted at a 4-position of a phenyl group

3-Me: a methyl group substituted at a 3-position of a phenyl group

4-Cl: a chlorine atom substituted at a 4-position of a phenyl group

4-MeO: a methoxy group substituted at a 4-position of a phenyl group

4-F: a fluorine atom substituted at a 4-position of a phenyl group

4-Pr: a propyl group substituted at a 4-position of a phenyl group

4-PhO: a phenoxy group substituted at a 4-position of a phenyl group

One of the hole transporting materials of the formula (3) may be independently used, or a combination of two or more thereof may be used. In addition, within a range not impairing the object of the present exemplary embodiment, other hole transporting materials other than the specific hole transporting material may be used together, as necessary.

Furthermore, it is preferable that the content at the time of containing the other hole transporting material in addition to the hole transporting material of the formula (3), for example, is less than or equal to 25% by weight with respect to the total hole transporting material.

Examples of the other hole transporting material include compounds such as triaryl amine compound, a benzidine compound, an aryl alkane compound, an aryl substituted ethylene compound, a stilbene compound, an anthracene compound, and a hydrazone compound.

A specific example of other hole transporting materials includes a compound represented by the formula (B-1) described below and a compound represented by the formula (B-2) described below.

(B-1)

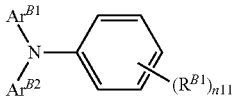

In the formula (B-1), $R^{B1}$ represents a hydrogen atom or a methyl group. n11 represents 1 or 2. $Ar^{B1}$ and $Ar^{B2}$ each independently represent a substituted or unsubstituted aryl group, $—C_6H_4—C(R^{B3})=C(R^{B4})(R^{B5})$, or $—C_6H_4—CH=CH—CH=C(R^{B6})(R^{B7})$, and $R^{B3}$ to $R^{B7}$ each independently represent a hydrogen atom, a substituted or unsubstituted alkyl group, or a substituted or unsubstituted aryl group. Examples of the substituent include a halogen atom, an alkyl group having 1 to 5 carbon atoms, an alkoxy group having 1 to 5 carbon atoms, or a substituted amino group which is substituted with an alkyl group having 1 to 3 carbon atoms.

(B-2)

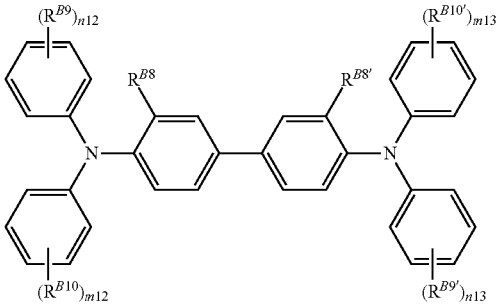

In the formula (B-2), $R^{B8}$ and $R^{B8'}$ may be identical to each other, or may be different from each other, and each independently represent a hydrogen atom, a halogen atom, an alkyl group having 1 to 5 carbon atoms, and an alkoxy group having 1 to 5 carbon atoms. $R^{B9}$, $R^{B9'}$, $R^{B10}$, and $R^{B10'}$ may be identical to each other, or may be different from each other, and each independently represent a halogen atom, an alkyl group having 1 to 5 carbon atoms, an alkoxy group having 1 to 5 carbon atoms, an amino group which is substituted with an alkyl group having 1 to 2 carbon atoms, a substituted or unsubstituted aryl group, $—C(R^{B11})=C(R^{B12})(R^{B13})$, or $—CH=CH—CH=C(R^{B14})(R^{B15})$, and $R^{B11}$ to $R^{B15}$ each independently represent a hydrogen atom, a substituted or unsubstituted alkyl group, or a substituted or unsubstituted aryl group. m12, m13, n12, and n13 each independently represent an integer of 0 to 2.

Here, among the compounds represented by the formula (B-1) and the compounds represented by the formula (B-2), the compound represented by the formula (B-1) having "$—C_6H_4—CH=CH—CH=C(R^{B6})(R^{B7})$" and the compound represented by the formula (B-2) having "$—CH=CH—CH=C(R^{B14})(R^{B15})$" are particularly preferable.

The content of the hole transporting material with respect to the total solid content of the photosensitive layer may be from 10% by weight to 40% by weight, and is preferably from 20% by weight to 35% by weight.

Furthermore, when two or more hole transporting materials are used together, the content of the hole transporting material is the content of the total hole transporting materials.

Ratio of Hole Transporting Material to Electron Transporting Material

A ratio of the hole transporting material to the electron transporting material is preferably from 50/50 to 90/10, and is more preferably from 60/40 to 80/20, by a weight ratio (the hole transporting material/the electron transporting material).

Furthermore, when other charge transporting materials are used together, this ratio is a ratio in total.

Other Additives

In the single-layer photosensitive layer, other known additives such as a surfactant, an antioxidizing agent, an optical stabilizer, and a thermal stabilizer may be included. In addition, when the single-layer photosensitive layer is a surface layer, fluorine resin particles, silicone oil, and the like may be included.

Formation of Single-Layer Photosensitive Layer

The single-layer photosensitive layer is formed by using a coating liquid for forming a photosensitive layer in which the components described above are added to a solvent.

Examples of the solvent include general organic solvents such as aromatic hydrocarbons such as benzene, toluene, xylene, and chlorobenzene, ketones such as acetone, and 2-butanone, halogenated aliphatic hydrocarbons such as methylene chloride, chloroform, and ethylene chloride, and cyclic or straight-chain ethers such as tetrahydrofuran, and ethyl ether. These solvents may be independently used or a combination of two or more thereof may be used.

In a method of dispersing particles (for example, the charge generating material) in the coating liquid for forming a photosensitive layer, a media disperser such as a ball mill, a vibration ball mill, an attritor, a sand mill, and a horizontal sand mill, and a media-less disperser such as agitation, an ultrasonic disperser, a roll mill, and a high pressure homogenizer are used. Examples of the high pressure homogenizer include a collision type homogenizer dispersing a dispersion at a high pressure state by using a liquid-liquid collision or a liquid-wall collision, a penetration type homogenizer dispersing a dispersion at a high pressure state by allowing the dispersion to penetrate a fine flow path, and the like.

Examples of a method of applying the coating liquid for forming a photosensitive layer onto the undercoat layer include a dipping coating method, an upthrust coating method, a wire bar coating method, a spray coating method, a blade coating method, a knife coating method, a curtain coating method, and the like.

The film thickness of the single-layer photosensitive layer is preferably from 5 μm to 60 μm, is more preferably from 5 μm to 50 μm, and is even more preferably from 10 μm to 40 μm.

Other Layers

As described above, other layers may be disposed in the photoreceptor according to the present exemplary embodiment, as necessary. Examples of the other layers include a protective layer which is disposed on the photosensitive layer as an outermost surface layer. The protective layer, for example, is disposed in order to prevent a chemical change in the photosensitive layer at the time of charging or to further improve the mechanical strength of the photosensitive layer. For this reason, as the protective layer, a layer configured of a cured film (a cross-linked film) may be applied. Examples of these layers include layers represented by 1) or 2) described below.

1) A layer configured of a cured film of a composition including a reactive group-containing charge transporting material in which a reactive group and a charge transporting skeleton are included in one molecule (that is, a layer including a polymer or a cross-linked product of the reactive group-containing charge transporting material)

2) A layer configured of a cured film of a composition including a non-reactive charge transporting material and a reactive group-containing non-charge transporting material which has a reactive group but not a charge transporting skeleton (that is, a layer including the non-reactive charge transporting material and a polymer or a cross-linked product of the reactive group-containing non-charge transporting material)

Examples of the reactive group of the reactive group-containing charge transporting material include known reactive groups such as a chain polymerizable group, an epoxy group, —OH, —OR [here, R represents an alkyl group], —$NH_2$, —SH, —COOH, and —$SiR^{Q1}{}_{3-Qn}(OR^{Q2})_{Qn}$ [here, $R^{Q1}$ represents a hydrogen atom, an alkyl group, or a substituted or non-substituted aryl group, and $R^{Q2}$ represents a hydrogen atom, an alkyl group, and a trialkyl silyl group. Qn represents an integer of 1 to 3].

Examples of the chain polymerizable group are not particularly limited insofar as the chain polymerizable group is a functional group which is able to be subjected to radical polymerization, and include a functional group having a group containing at least a carbon double bond. Specifically, examples of the chain polymerizable group include a group containing at least one selected from a vinyl group, a vinyl ether group, a vinyl thioether group, a vinyl phenyl group, a styryl group, an acryloyl group, a methacryloyl group, and derivatives thereof, and the like. Among them, as the chain polymerizable group, the group containing at least one selected from a vinyl group, a vinyl phenyl group, a styryl group, an acryloyl group, a methacryloyl group, and derivatives thereof is preferable from a viewpoint of excellent reactivity.

Examples of the charge transporting skeleton of the reactive group-containing charge transporting material are not particularly limited insofar as the charge transporting skeleton has a known structure in the electrophotographic photoreceptor, and include a skeleton derived from a nitrogen-containing hole transporting compound such as a triaryl amine compound, a benzidine compound, and a hydrazone compound, and a structure which is conjugated with a nitrogen atom. Among them, the triaryl amine skeleton is preferable.

The reactive group-containing charge transporting material having a reactive group and a charge transporting skeleton, the non-reactive charge transporting material, and the reactive group-containing non-charge transporting material may be selected from known materials.

Other known additives may be included in the protective layer.

The formation of the protective layer is not particularly limited, but is performed by using a known forming method, and for example, in the formation of the protective layer, a coated film coated with a coating liquid for forming a protective layer in which the components described above are added to a solvent is formed, and the coated film is dried and is subjected to a hardening treatment such as heating, as necessary.

Examples of the solvent for preparing the coating liquid for forming a protective layer include an aromatic solvent such as toluene, and xylene; a ketone solvent such as methyl ethyl ketone, methyl isobutyl ketone, and cyclohexanone; an ester solvent such as ethyl acetate, and butyl acetate; an ether solvent such as tetrahydrofuran, and dioxane; a cellosolve solvent such as ethylene glycol monomethyl ether; an alcohol solvent such as isopropyl alcohol, and butanol, and the like. These solvents may be independently used or a combination of two or more thereof may be used.

Furthermore, the coating liquid for forming a protective layer may be a solventless coating liquid.

Examples of a method of applying the coating liquid for forming a protective layer onto the photosensitive layer include general methods such as a dipping coating method, an upthrust coating method, a wire bar coating method, a spray coating method, a blade coating method, a knife coating method, and a curtain coating method.

The film thickness of the protective layer, for example, is preferably from 1 μm to 20 μm, and is more preferably from 2 μm to 10 μm.

Image Forming Apparatus (and Process Cartridge)

The image forming apparatus according to the present exemplary embodiment is provided with an electrophotographic photoreceptor, a charging unit that charges the surface of the electrophotographic photoreceptor, an electrostatic latent image forming unit that forms an electrostatic latent image on the surface of the charged electrophotographic photoreceptor, a developing unit that develops the electrostatic latent image formed on the surface of the electrophotographic photoreceptor by a developer including a toner to form a toner image, and a transfer unit that transfers the toner image onto a surface of a recording medium. Further, the electrophotographic photoreceptor according to the present exemplary embodiment is applied as the electrophotographic photoreceptor.

As the image forming apparatus according to the present exemplary embodiment, known image forming apparatuses provided with a device including a fixing unit that fixes a toner image transferred to the surface of a recording medium; a direct transfer type device that directly transfers the toner image formed on the surface of the electrophotographic photoreceptor to a recording medium; an intermediate transfer type device that primarily transfers the toner image formed on the surface of the electrophotographic photoreceptor, and secondarily transfers the toner image transferred to the surface of an intermediate transfer member to the surface of the recording medium; a device provided with a cleaning unit that cleans the surface of the electrophotographic photoreceptor before charging, after the transfer of the toner image; a device provided with a charge erasing unit that erases charges by irradiating charge erasing light onto the surface of an image holding member before charging, after the transfer of the toner image; a device provided with an electrophotographic photoreceptor heating unit that increases the temperature of the electrophotographic photoreceptor to reduce the relative temperature; and the like are applied.

In the case of the intermediate transfer type device case, for the transfer unit, for example, a configuration in which a intermediate transfer member to the surface of which the toner image is transferred, a first transfer unit that primarily transfers a toner image formed on the surface of an image holding member to the surface of the intermediate transfer member, and a secondary transfer unit that secondarily transfers the toner image transferred to the surface of the intermediate transfer member is applied.

The image forming apparatus according to the present exemplary embodiment is any one of a dry development type image forming apparatus and a wet development type (development type using a liquid developer) image forming apparatus.

Furthermore, in the image forming apparatus according to the present exemplary embodiment, for example, a part provided with the electrophotographic photoreceptor may be a cartridge structure (process cartridge) that is detachable from an image forming apparatus. As the process cartridge, for example, a process cartridge including the electrophotographic photoreceptor according to the present exemplary embodiment is suitably used. Further, the process cartridge may include, in addition to the electrophotographic photoreceptor, for example, at least one selected from the group consisting of a charging means, an electrostatic latent image forming unit, a developing unit, and a transfer unit.

Hereinafter, one example of the image forming apparatuses according to the present exemplary embodiment is shown, but the present invention is not limited thereto. Further, the main parts shown in the figures are described, and explanation of the others will be omitted.

Figure 2:
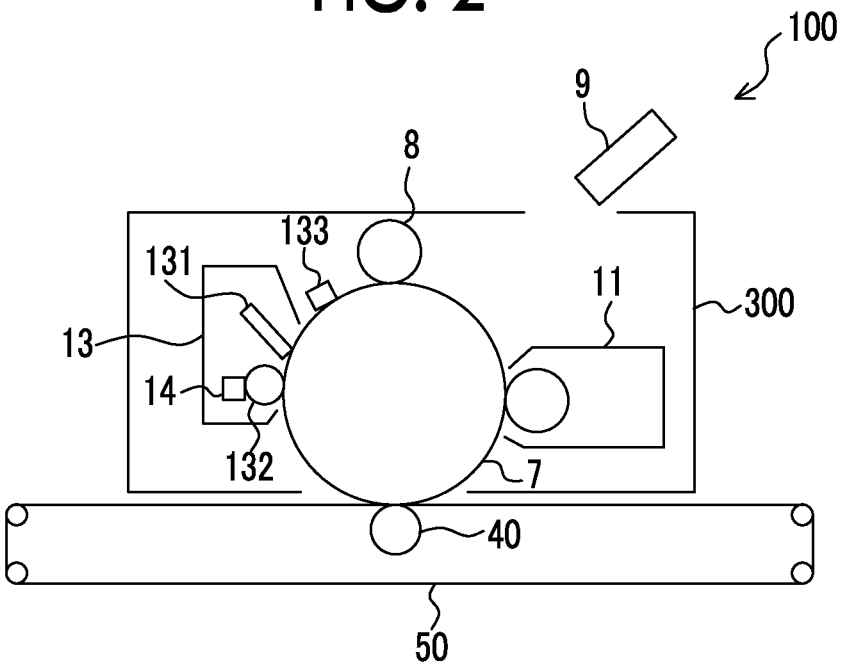
FIG. 2 is a schematic configuration diagram illustrating an image forming apparatus according to a present exemplary embodiment.

FIG. 2 is a schematic structural view showing an example of the image forming apparatus according to the present exemplary embodiment.

The image forming apparatus 100 according to the present exemplary embodiment is provided with a process cartridge 300 provided with an electrophotographic photoreceptor 7 as shown in FIG. 2, an exposure device 9 (one example of the electrostatic latent image forming unit), a transfer device (primary transfer device), and an intermediate transfer member 50. Further, in the image forming apparatus 100, the exposure device 9 is arranged at a position where the exposure device 9 may radiate light onto the electrophotographic photoreceptor 7 through an opening in the process cartridge 300, and the transfer device 40 is arranged at a position opposite to the electrophotographic photoreceptor 7 by the intermediary of the intermediate transfer member 50. The intermediate transfer member 50 is arranged to contact partially the electrophotographic photoreceptor 7. Further, although not shown in the figure, the apparatus also includes a secondary transfer device that transfers a toner image transferred onto the intermediate transfer member 50 to a recording medium (for example, paper). Further, the intermediate transfer member 50, the transfer device 40 (primary transfer device), and the secondary transfer device (not shown) correspond to an example of the transfer unit.

The process cartridge 300 in FIG. 2 supports, in a housing, the electrophotographic photoreceptor 7, a charging device 8 (one example of the charging unit), a developing device 11 (one example of the cleaning unit), and a cleaning device 13 (one example of the cleaning unit) as a unit. The cleaning device 13 has a cleaning blade (one example of the cleaning member) 131, and the cleaning blade 131 is arranged so as to be in contact with the surface of the electrophotographic photoreceptor 7. Further, the cleaning member is not an exemplary embodiment of the cleaning blade 131, may be a conductive or insulating fibrous member, and may be used singly or in combination with the cleaning blade 131.

Furthermore, in FIG. 2, as the image forming apparatus, an example is illustrated in which a fibrous member 132 (in the shape of a roll) supplying an antifriction 14 onto the surface of the electrophotographic photoreceptor 7, and a fibrous member 133 (in the shape of a flat brush) aiding cleaning are provided in the image forming apparatus, but the fibrous member 132 and the fibrous member 133 are arranged, as necessary.

Hereinafter, the respective configurations of the image forming apparatus according to the present exemplary embodiment will be described.

Charging Device

As the charging device 8, for example, a contact type charging device using a conductive or semiconductive charging roll, a charging brush, a charging film, a charging rubber blade, a charging tube, or the like is used. Further, known charging devices themselves, such as a non-contact type roller charging device, and a scorotron charging device and a corotron charging device, each using corona discharge are also used.

Exposure Device

The exposure device 9 may be an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in the range of the spectral sensitivity wavelengths of the electrophotographic photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a planar light emission type laser light source capable of attaining a multi-beam output.

Developing Device

As the developing device 11, for example, a common developing device, in which a magnetic or non-magnetic single-component or two-component developer is contacted or not contacted for forming an image, may be used. Such a developing device 11 is not particularly limited as long as it has the above-described functions, and may be appropriately selected according to the intended use. Examples thereof include a known developing device in which the single-component or two-component developer is applied to the electrophotographic photoreceptor 7 using a brush or a roller. Among these, the developing device using developing roller retaining developer on the surface thereof is preferable.

The developer used in the developing device 11 may be a single-component developer formed of a toner singly or a two-component developer formed of a toner and a carrier. Further, the toner may be magnetic or non-magnetic. As the developer, known ones may be applied.

Cleaning Device

As the cleaning device 13, a cleaning blade type device provided with the cleaning blade 131 is used.

Further, in addition to the cleaning blade type, a fur brush cleaning type and a type of performing developing and cleaning at once may also be employed.

Transfer Device

Examples of transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

Figure 3:
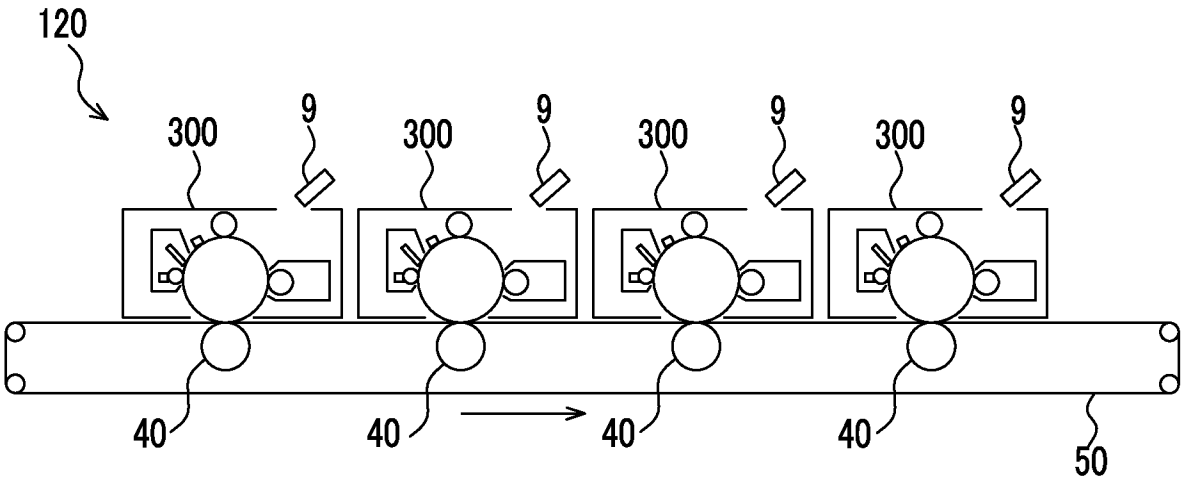
FIG. 3 is a schematic configuration diagram illustrating an image forming apparatus according to another present exemplary embodiment.

FIG. 3 is a schematic configuration diagram illustrating another example of the image forming apparatus according to the present exemplary embodiment.

An image forming apparatus 120 illustrated in FIG. 3 is a tandem type multi-color image forming apparatus in which four process cartridges 300 are mounted. In the image forming apparatus 120, the four process cartridges 300 are respectively arranged on the intermediate transfer member 50 in parallel, and one electrophotographic photoreceptor is used for one color. Furthermore, the image forming apparatus 120 has the same configuration as that of the image forming apparatus 100 except that the image forming apparatus 120 is a tandem type image forming apparatus.

Furthermore, the image forming apparatus 100 according to the present exemplary embodiment is not limited to the configuration described above, and for example, the image forming apparatus 100 may have a configuration in which a first erasing device for easily removing the remaining toner by aligning the polarity of the toner using a cleaning brush is disposed on a downstream side in a rotation direction of the electrophotographic photoreceptor 7 from the transfer device and an upstream side in a rotation direction of the electrophotographic photoreceptor from the cleaning device 13 around the electrophotographic photoreceptor 7, or a configuration in which a second erasing device for erasing the surface of the electrophotographic photoreceptor 7 is disposed on the downstream side in the rotation direction of the electrophotographic photoreceptor from the cleaning device 13 and on the upstream side in the rotation direction of the electrophotographic photoreceptor from the charging device 8.

In addition, the image forming apparatus 100 according to the present exemplary embodiment is not limited to the configuration described above, and for example, a direct transfer type image forming apparatus may be adopted in which the toner image formed on the electrophotographic photoreceptor 7 is directly transferred onto the recording medium.

EXAMPLES

Hereinafter, the present exemplary embodiment will be described in detail with reference to examples and comparative examples, but the present exemplary embodiment is not limited to these examples. Furthermore, in the following description, "parts", "parts by weight", and "%" are on a weight basis unless particularly stated otherwise.

Example 1

Formation of Photosensitive Layer

A mixture composed of 1.5 parts by weight of hydroxygallium phthalocyanine pigment shown in Table 1 described later as a charge generating material, 60.5 parts by weight of a bisphenol Z polycarbonate resin (a viscosity average molecular weight: 50,000) as a binder resin, a composition ratio shown in Table 1 described later (however, the detail of the composition ratio will be shown in Table 3) as an electron transporting material, 34 parts by weight of a hole transporting material shown in Table 1 described later as a hole transporting material, and 250 parts by weight of tetrahydrofuran as a solvent is dispersed in a sand mill for 4 hours by using glass beads having a diameter of 1 mmϕ), and thus a coating liquid for forming a photosensitive layer is obtained.

The obtained coating liquid for forming a photosensitive layer is applied onto an aluminum base material having a diameter of 30 mm, a length of 244.5 mm, and a thickness of 1 mm by using a dipping coating method, and is dried and cured at 140° C. for 30 minutes, and thus a single-layer photosensitive layer having a thickness of 30 μm is formed.

An electrophotographic photoreceptor is prepared through the steps described above.

Examples 2 to 17 and Comparative Examples 1 to 20

An electrophotographic photoreceptor is prepared in the same manner as in Example 1 except that the composition ratio (however, the detail of the composition ratio will be shown in Table 3) of the electron transporting material (in the table, described as "ETM"), the type and the additive amount of the hole transporting material (in the table, described as "HTM"), and the type of the charge generating material (in the table, described as "CGM") are changed according to Tables 1 and 2. However, when the amount of each component is changed, the amount of the binder resin (the number of parts) is increased or decreased such that the solid content of the photosensitive layer is 100 parts by weight.

Furthermore, in Tables 1 to 3, "–" indicates that the material is not added.

Evaluation

The following evaluation is performed with respect to each obtained electrophotographic photoreceptor. The results are shown in Tables 1 and 2. Furthermore, in each obtained electrophotographic photoreceptor, the average loss elastic modulus of the photosensitive layer which includes the electron transporting material at a composition ratio shown in Table 3 (the average loss elastic modulus E" at the time of measuring dynamic viscoelasticity under conditions including a temperature of 35° C. to 50° C. and a frequency of 0.5 Hz) is shown in Table 3.

Evaluation of Color Spot

The evaluation of the color spot is performed as follows. After 2,000 halftones of 50% are printed at a charged voltage of +800 V in a high-temperature and high-humidity environment of 28° C. and 85 RH % by using a modified cleaner of HL5340D manufactured by Brother Industries, Ltd. in which the photoreceptor is mounted, the device is stopped overnight, the white paper is transported into the device on the next morning, the number of color spots which form on white paper is counted, and the evaluation is performed on the following basis.

A: The color spot does not occur.

B: The number of color spots is from 1 to 9.

C: The number of color spots is greater than or equal to 10.

Evaluation of Sensitivity of Photoreceptor

The sensitivity of the photoreceptor is evaluated as a half-reduction exposure amount when it is charged to +800 V. Specifically, the photoreceptor is charged to +800 V in an environment of 20° C. and 40% RH, using an electrostatic copying paper testing apparatus (Electrostatic analyzer EPA-8100, manufactured by Kawaguchi Electric Works), and then irradiated with monochromatic light with 800 nm obtained from light of a tungsten lamp using a monochromator so as to provide 1 $\mu W/cm^2$ on the surface of the photoreceptor.

Then, a potential V0 (V) of the photoreceptor surface immediately after charging, and a half-reduction exposure amount $E_{1/2}$ ($\mu J/cm^2$) at which the surface potential became 1/2×V0 (V) by irradiation of the photoreceptor surface with light are measured. The evaluation basis is as follows.

A; The half-exposure amount is less than or equal to 0.15 $\mu J/cm^2$.

B; The half-exposure amount is greater than 0.15 $\mu J/cm^2$ and less than or equal to 0.18 $\mu J/cm^2$.

C; The half-exposure amount is greater than 0.18 $\mu J/cm^2$ and less than or equal to 0.20 $\mu J/cm^2$.

D; The half-exposure amount is greater than 0.20 $\mu J/cm^2$.

TABLE 1

| | ETM Composition Ratio | HTM Type-1/ Number of Parts | HTM Type-2/ Number of Parts | CGM Type/ Number of Parts | Color spot | Sensitivity |
|---|---|---|---|---|---|---|
| Example 1 | Composition Ratio 5 | HTM1/34 Parts | — | CGM1/1.5 Parts | A | B |
| Example 2 | Composition Ratio 6 | HTM1/34 Parts | — | CGM1/1.5 Parts | B | B |
| Example 3 | Composition Ratio 9 | HTM1/34 Parts | — | CGM1/1.5 Parts | A | C |
| Example 4 | Composition Ratio 10 | HTM1/34 Parts | — | CGM1/1.5 Parts | B | B |
| Example 5 | Composition Ratio 13 | HTM1/34 Parts | — | CGM1/1.5 Parts | A | C |
| Example 6 | Composition Ratio 14 | HTM1/34 Parts | — | CGM1/1.5 Parts | A | B |
| Example 7 | Composition Ratio 17 | HTM1/34 Parts | — | CGM1/1.5 Parts | A | C |
| Example 8 | Composition Ratio 18 | HTM1/34 Parts | — | CGM1/1.5 Parts | A | C |
| Example 9 | Composition Ratio 21 | HTM1/34 Parts | — | CGM1/1.5 Parts | B | C |
| Example 10 | Composition Ratio 25 | HTM1/34 Parts | — | CGM1/1.5 Parts | A | C |
| Example 11 | Composition Ratio 26 | HTM1/34 Parts | — | CGM1/1.5 Parts | A | C |
| Example 12 | Composition Ratio 27 | HTM1/34 Parts | — | CGM1/1.5 Parts | A | C |
| Example 13 | Composition Ratio 28 | HTM1/34 Parts | — | CGM1/1.5 Parts | A | C |
| Example 14 | Composition Ratio 14 | HTM2/34 Parts | — | CGM1/1.5 Parts | A | C |
| Example 15 | Composition Ratio 14 | HTM3/34 Parts | — | CGM1/1.5 Parts | A | C |
| Example 16 | Composition Ratio 14 | HTM1/28 Parts | HTM5/8 Parts | CGM1/1.5 Parts | A | C |
| Example 17 | Composition Ratio 14 | HTM1/34 Parts | — | CGM2/1.5 Parts | A | A |

TABLE 2

| | ETM Composition Ratio | HTM Type-1/ Number of Parts | HTM Type-2/ Number of Parts | CGM Type/ Number of Parts | Color spot | Sensitivity |
|---|---|---|---|---|---|---|
| Comparative Example 1 | Composition Ratio 3 | HTM1/34 Parts | — | CGM1/1.5 Parts | C | B |
| Comparative Example 2 | Composition Ratio 7 | HTM1/34 Parts | — | CGM1/1.5 Parts | C | B |
| Comparative Example 3 | Composition Ratio 11 | HTM1/34 Parts | — | CGM1/1.5 Parts | C | B |
| Comparative Example 4 | Composition Ratio 15 | HTM1/34 Parts | — | CGM1/1.5 Parts | C | B |
| Comparative Example 5 | Composition Ratio 19 | HTM1/34 Parts | — | CGM1/1.5 Parts | C | C |
| Comparative Example 6 | Composition Ratio 22 | HTM1/34 Parts | — | CGM1/1.5 Parts | C | C |
| Comparative Example 7 | Composition Ratio 24 | HTM1/34 Parts | — | CGM1/1.5 Parts | C | C |
| Comparative Example 8 | Composition Ratio 1 | HTM1/34 Parts | — | CGM1/1.5 Parts | A | D |
| Comparative Example 9 | Composition Ratio 2 | HTM1/34 Parts | — | CGM1/1.5 Parts | B | D |
| Comparative Example 10 | Composition Ratio 3 | HTM1/34 Parts | — | CGM1/1.5 Parts | C | D |
| Comparative Example 11 | Composition Ratio 4 | HTM1/34 Parts | — | CGM1/1.5 Parts | A | D |
| Comparative Example 12 | Composition Ratio 8 | HTM1/34 Parts | — | CGM1/1.5 Parts | A | D |
| Comparative Example 13 | Composition Ratio 12 | HTM1/34 Parts | — | CGM1/1.5 Parts | A | D |
| Comparative Example 14 | Composition Ratio 16 | HTM1/34 Parts | — | CGM1/1.5 Parts | A | D |
| Comparative Example 15 | Composition Ratio 20 | HTM1/34 Parts | — | CGM1/1.5 Parts | A | D |
| Comparative Example 16 | Composition Ratio 23 | HTM1/34 Parts | — | CGM1/1.5 Parts | A | D |
| Comparative Example 17 | Composition Ratio 29 | HTM1/34 Parts | — | CGM1/1.5 Parts | A | D |
| Comparative Example 18 | Composition Ratio 14 | HTM4/34 Parts | — | CGM1/1.5 Parts | A | D |
| Comparative Example 19 | Composition Ratio 14 | HTM5/34 Parts | — | CGM1/1.5 Parts | A | D |
| Comparative Example 20 | Composition Ratio 14 | HTM1/34 Parts | — | CGM3/1.5 Parts | A | D |

TABLE 3

| | Type of ETM | Additive Amount of ETM (Number of Parts) | Type of ETM | Additive Amount of ETM (Number of Parts) | Total Additive Amount of ETM (Number of Parts) | Average Loss Elastic Modulus E'' |
|---|---|---|---|---|---|---|
| Composition Ratio 1 | ETM1 | 3 | — | 0 | 3 | 6.451E+05 |
| Composition Ratio 2 | ETM1 | 4 | — | 0 | 4 | 8.440E+05 |
| Composition Ratio 3 | ETM1 | 5 | — | 0 | 5 | 1.043E+06 |
| Composition Ratio 4 | ETM1 | 2 | ETM2 | 1 | 3 | 4.807E+05 |
| Composition Ratio 5 | ETM1 | 3 | ETM2 | 1 | 4 | 6.796E+05 |
| Composition Ratio 6 | ETM1 | 4 | ETM2 | 1 | 5 | 8.786E+05 |
| Composition Ratio 7 | ETM1 | 5 | ETM2 | 1 | 6 | 1.077E+06 |
| Composition Ratio 8 | ETM1 | 1 | ETM2 | 2 | 3 | 3.164E+05 |
| Composition Ratio 9 | ETM1 | 2 | ETM2 | 2 | 4 | 5.153E+05 |
| Composition Ratio 10 | ETM1 | 4 | ETM2 | 2 | 6 | 9.131E+05 |
| Composition Ratio 11 | ETM1 | 5 | ETM2 | 2 | 7 | 1.112E+06 |
| Composition Ratio 12 | — | 0 | ETM2 | 5 | 5 | 2.212E+05 |
| Composition Ratio 13 | ETM1 | 1 | ETM2 | 5 | 6 | 4.201E+05 |
| Composition Ratio 14 | ETM1 | 3 | ETM2 | 5 | 8 | 8.180E+05 |
| Composition Ratio 15 | ETM1 | 4 | ETM2 | 5 | 9 | 1.017E+06 |
| Composition Ratio 16 | — | 0 | ETM2 | 11 | 11 | 4.287E+05 |
| Composition Ratio 17 | ETM1 | 1 | ETM2 | 11 | 12 | 6.276E+05 |
| Composition Ratio 18 | ETM1 | 2 | ETM2 | 11 | 13 | 8.265E+05 |
| Composition Ratio 19 | ETM1 | 3 | ETM2 | 11 | 14 | 1.025E+06 |
| Composition Ratio 20 | — | 0 | ETM2 | 18 | 18 | 6.707E+05 |
| Composition Ratio 21 | ETM1 | 1 | ETM2 | 18 | 19 | 8.697E+05 |
| Composition Ratio 22 | ETM1 | 2 | ETM2 | 18 | 20 | 1.069E+06 |
| Composition Ratio 23 | — | 0 | ETM2 | 22 | 22 | 8.091E+05 |
| Composition Ratio 24 | ETM1 | 1 | ETM2 | 22 | 23 | 1.008E+06 |
| Composition Ratio 25 | ETM4 | 4 | ETM2 | 1 | 5 | 8.786E+05 |
| Composition Ratio 26 | ETM5 | 4 | ETM2 | 1 | 5 | 8.774E+05 |
| Composition Ratio 27 | ETM6 | 4 | ETM2 | 1 | 5 | 8.901E+05 |
| Composition Ratio 28 | ETM1 | 3 | ETM3 | 5 | 8 | 8.412E+05 |
| Composition Ratio 29 | ETM1 | 3 | ETM7 | 5 | 8 | 8.422E+05 |

From the results described above, it is known that in the present examples, the color spot is reduced, and the sensitivity increases compared to the comparative examples.

Furthermore, the details of abbreviations in Table 1 to Table 3 are as follows.

Electron Transporting Material

ETM1: Exemplary Compound (1-14) of the electron transporting material represented by the formula (1)

ETM2: Exemplary Compound (2-3) of the electron transporting material represented by the formula (2)

ETM3: Exemplary Compound (2-2) of the electron transporting material represented by the formula (2)

ETM4: Exemplary Compound (1-2) of the electron transporting material represented by the formula (1)

ETM5: Exemplary Compound (1-11) of the electron transporting material represented by the formula (1)

ETM6: Exemplary Compound (1-17) of the electron transporting material represented by the formula (1)

ETM7: An electron transporting material ETM7 having the following structure

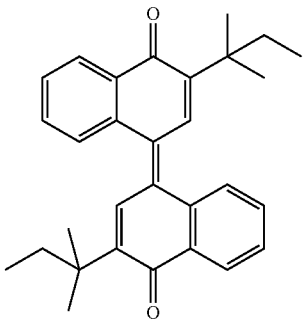

ETM7

Hole Transporting Material

HTM1: Exemplary Compound (3-1) of the hole transporting material represented by the formula (3)

HTM2: Exemplary Compound (3-21) of the hole transporting material represented by the formula (3)

HTM3: Exemplary Compound (3-41) of the hole transporting material represented by the formula (3)

HTM4: A hole transporting material HTM4 having the following structure

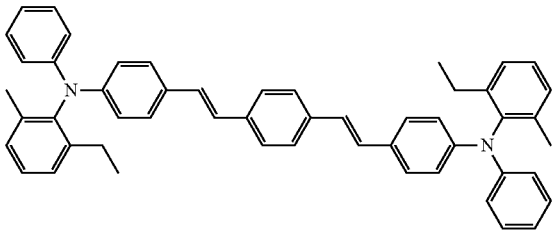

HTM4

HTM5: N,N'-diphenyl-N,N'-bis(3-methyl phenyl)-[1,1'] biphenyl-4,4'-diamine (a hole transporting material HTM5 having the following structure)

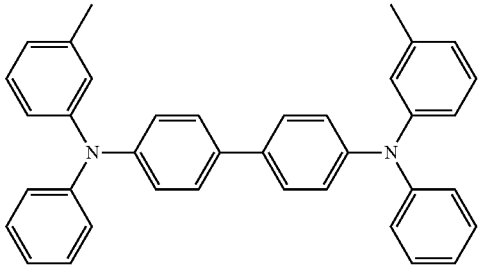

HTM5

Charge Generating Material

CGM1 ClGaPC): Chlorogallium phthalocyanine: A chlorogallium phthalocyanine pigment having a diffraction peak in a position in which the Bragg angle (2θ±0.2°) of an X-ray diffraction spectrum using a Cukα characteristic X-ray is at least 7.4°, 16.6°, 25.5°, and 28.3° (the maximum peak wavelength of the spectral absorption spectrum in a wavelength region of 600 nm to 900 nm: 780 nm, the average particle diameter: 0.15 μm, the maximum particle diameter: 0.2 μm, and the specific surface area value: 56 $m^2/g$)

CGM2 (HOGaPC): Hydroxygalliumphthalocyanine (V-type): A V-type hydroxygallium phthalocyanine pigment having a diffraction peak in a position in which the Bragg angle (2θ±0.2°) of an X-ray diffraction spectrum using a Cukα characteristic X-ray is at least 7.3°, 16.0°, 24.9°, and 28.0° (the maximum peak wavelength of the spectral absorption spectrum in a wavelength region of 600 nm to 900 nm: 820 nm, the average particle diameter: 0.12 μm, the maximum particle diameter: 0.2 μm, and the specific surface area value: 60 $m^2/g$)

CGM3 ($H_2PC$): An X type metal-free phthalocyanine pigment (phthalocyanine in which two hydrogen atoms are coordinated in the center of a phthalocyanine skeleton)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate, and a single-layer photosensitive layer which is provided on the conductive substrate and contains a binder resin, at least one charge generating material selected from a hydroxygallium phthalocyanine pigment and a chlorogallium phthalocyanine pigment, a first electron transporting material represented by the following formula (1), a second electron transporting material represented by the following formula (2), and a hole transporting material represented by the following formula (3), wherein a total content of all electron transporting materials is greater than or equal to 4 parts by weight with respect to 100 parts by weight of a total solid content of the photosensitive layer, and an average loss elastic modulus E" of the photosensitive layer, which is obtained by measuring dynamic viscoelasticity at a temperature of from 35° C. to 50° C. and a frequency of 0.5 Hz, is less than or equal to $1.000\times10^6$:

(1)

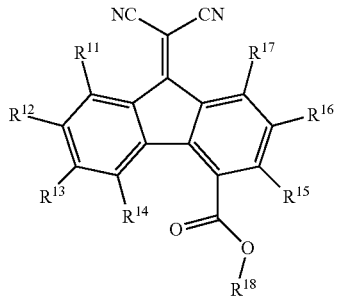

wherein $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group, $R^{18}$ represents an alkyl group, $-L^{19}-O-R^{20}$, an aryl group, or an aralkyl group, $L^{19}$ represents an alkylene group, and $R^{20}$ represents an alkyl group;

(2)

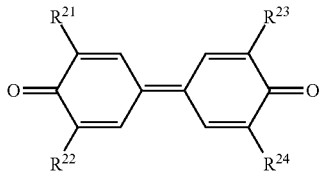

wherein $R^{21}$, $R^{22}$, $R^{23}$, and $R^{24}$ each independently represent a hydrogen atom, an alkyl group, an alkoxy group, a halogen atom, or a phenyl group; and (3)

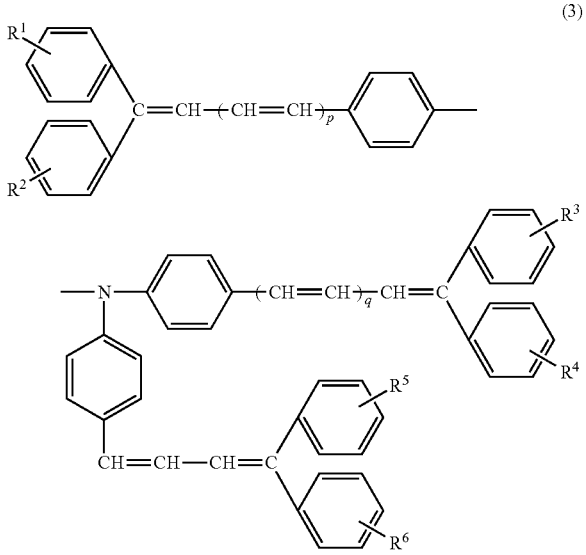

wherein $R^1$, $R^2$, $R^3$, $R^4$, $R^5$, and $R^6$ each independently represent a hydrogen atom, an alkyl group, an alkoxy group, a phenoxy group, a halogen atom, or a phenyl group which may have a substituent selected from an alkyl group, an alkoxy group, and a halogen atom, and p and q each independently represent 0 or 1, wherein a weight ratio of the first electron transporting material to the second electron transporting material (the first electron transporting material of the formula (1)/the second electron transporting material of the formula (2)) is from 2/1 to 4/1.

2. The electrophotographic photoreceptor according to claim 1, wherein the average loss elastic modulus E" of the single-layer photosensitive layer is less than or equal to $8.0\times10^5$.

3. The electrophotographic photoreceptor according to claim 1, wherein the charge generating material is a V-type hydroxygallium phthalocyanine pigment.

4. The electrophotographic photoreceptor according to claim 1, wherein the hole transporting material is a hole transporting material in which p and q in the formula (3) each represents 1.

5. The electrophotographic photoreceptor according to claim 1, wherein the first electron transporting material is an electron transporting material represented by the formula (1) wherein $R^{18}$ represents an aralkyl group or a branched alkyl group having 5 to 10 carbon atoms.

6. The electrophotographic photoreceptor according to claim 1, wherein the second electron transporting material is an electron transporting material represented by the formula (2) wherein at least one of $R^{21}$ to $R^{24}$ represent a branched alkyl group having 4 carbon atoms.

7. A process cartridge, which is detachable from an image forming apparatus, comprising:

the electrophotographic photoreceptor according to claim 1.

8. An image forming apparatus, comprising:

the electrophotographic photoreceptor according to claim 1;

a charging unit charging a surface of the electrophotographic photoreceptor;

an electrostatic latent image forming unit forming an electrostatic latent image on the charged surface of the electrophotographic photoreceptor;

a developing unit forming a toner image by developing the electrostatic latent image formed on the surface of the electrophotographic photoreceptor using a developer including a toner; and a transfer unit transferring the toner image onto a surface of a recording medium.

9. The electrophotographic photoreceptor according to claim 1, wherein a weight ratio of the first electron transporting material to the second electron transporting material (the first electron transporting material of the formula (1)/the second electron transporting material of the formula (2)) is from 3/1 to 4/1.

* * * * *